US007322492B2

(12) United States Patent
Kawaguchi et al.

(10) Patent No.: US 7,322,492 B2
(45) Date of Patent: Jan. 29, 2008

(54) ADAPTOR FOR BEVERAGE PACK AND BEVERAGE FEEDER

(75) Inventors: Susumu Kawaguchi, Yokkaichi (JP); Tsukasa Yoshikawa, Tokyo (JP)

(73) Assignee: Sankyo Seiyakukogyo Co., Ltd., Mie (JP)

( * ) Notice: Subject to any disclaimer, the term of this patent is extended or adjusted under 35 U.S.C. 154(b) by 457 days.

(21) Appl. No.: 10/451,756

(22) PCT Filed: Dec. 19, 2001

(86) PCT No.: PCT/JP01/11129

§ 371 (c)(1),
(2), (4) Date: Nov. 28, 2003

(87) PCT Pub. No.: WO02/49932

PCT Pub. Date: Jun. 27, 2002

(65) Prior Publication Data

US 2004/0104246 A1 Jun. 3, 2004

(30) Foreign Application Priority Data

Dec. 20, 2000 (JP) ..... 2000-387163

(51) Int. Cl.
*B67D 5/00* (2006.01)

(52) U.S. Cl. ..... 222/91; 229/103.1

(58) Field of Classification Search ..... 222/91, 222/81–83, 88; 220/705, 709; 215/229, 215/388, 389; 604/78–85; 229/103.1
See application file for complete search history.

(56) References Cited

U.S. PATENT DOCUMENTS 1,355,010 A 10/1920 Strongson
2,598,843 A 6/1952 Sherwood
3,278,083 A * 10/1966 Serafini ..... 222/91

(Continued)

FOREIGN PATENT DOCUMENTS

DE 26 55 081 A 6/1978

(Continued)

OTHER PUBLICATIONS

Office Action from Japanese counterpart application 2002-551444.

(Continued)

*Primary Examiner*—Lien M. Ngo
(74) *Attorney, Agent, or Firm*—Knobbe Martens Olson & Bear LLP

(57) ABSTRACT

A fixing member is fixed to a beverage pack in a state in which a through-hole and an opening are aligned. Next, the pointed end of an adapter body is inserted into the opening through the through-hole. This causes the pointed end to puncture a film and pass through the opening, but a flange serves as a stopper so that just the pointed end is inserted into the beverage pack. At this point the surrounding area is kept liquid-tight by a seal, and the adapter body is prevented from falling out by ridges provided to this. One end of a tube is connected to a joint of the adapter body. A catheter is connected to the other end of this tube, allowing a nutritional beverage contained in the beverage pack to be discharged directly from the catheter.

20 Claims, 8 Drawing Sheets

U.S. PATENT DOCUMENTS

| | | | | | |
|---|---|---|---|---|---|
| 3,990,597 | A | | 11/1976 | Barton | |
| 4,375,864 | A | * | 3/1983 | Savage | 222/81 |
| 4,390,017 | A | * | 6/1983 | Harrison et al. | 604/270 |
| 5,141,134 | A | * | 8/1992 | Machado | 222/83.5 |
| 5,348,217 | A | * | 9/1994 | Bettle et al. | 229/103.1 |
| 5,407,099 | A | | 4/1995 | Heuke et al. | |
| 5,497,909 | A | * | 3/1996 | Wirsig et al. | 222/82 |
| 5,531,681 | A | * | 7/1996 | Walton et al. | 604/83 |
| 5,735,841 | A | | 4/1998 | Bourguignon et al. | |
| 5,823,422 | A | * | 10/1998 | Collier et al. | 229/103.1 |
| 5,855,298 | A | | 1/1999 | Teetsel, III et al. | |
| 6,378,730 | B1 | * | 4/2002 | Reddy et al. | 222/83 |

FOREIGN PATENT DOCUMENTS

| | | |
|---|---|---|
| DE | 33 39 257 A | 5/1985 |
| DE | 3906418 A1 | 9/1990 |
| EP | 1 201 598 A | 5/2002 |
| JP | 64-86971 | 3/1989 |
| JP | 7-27600 | 5/1995 |
| WO | WO 00/027711 A | 5/2000 |

OTHER PUBLICATIONS

Office Action from Japanese counterpart application 2001-369985.

* cited by examiner

ADAPTOR FOR BEVERAGE PACK AND BEVERAGE FEEDER

FIELD OF THE INVENTION

This invention relates to a beverage pack adapter for supplying the beverage contained in a brick pack or other such commercially available beverage pack directly to a catheter or the like, and to a beverage supply device that makes use of this adapter.

BACKGROUND ART

Nutritional beverages packaged in rectangular brick packs are marketed for the purpose of providing suitable nutritional supplementation to hospital patients, infirm persons, or people who are severely fatigued. Patients or infirm persons can ingest nutritional beverages enterally by inserting a straw into the opening of a brick pack and sucking out the nutritional beverage.

Since the above brick packs are intended for patients and so forth who are strong enough to raise up, patients or children for whom oral ingestion is difficult, for example, cannot consume a nutritional beverage while it is still in a brick pack. Consequently, a physician or nurse must first transfer the nutritional beverage in a brick pack into a trans-nasal administration device and then administer the nutritional beverage to the patient or child from this nasal administration device. Specifically, the nutritional beverage contained in the brick pack is transferred into the bag of a nasal administration device, this bag is hung at a suitable height, a catheter provided to the distal end of a tube extending from the bottom of the pack is inserted through the nostril into the stomach or intestine of the prostrate patient or child, and the nutritional beverage is administered as needed.

However, having to first transfer the nutritional beverage in a brick pack increases the work load entailed by the treatment or care. Also, it is conceivable that the nutritional beverage may be exposed to harmful bacteria or drugs while being transferred from the brick pack to the bag, so this transfer is also undesirable from a hygiene standpoint.

DISCLOSURE OF THE INVENTION

The present invention was conceived in light of the above situation, and it is an object thereof to provide a beverage pack adapter that facilitates the work of medical treatment or health care and with which a nutritional beverage can be ingested consumed in a hygienically favorable manner, and a beverage supply device that makes use of this adapter.

To solve the stated problems, the beverage pack adapter of the present invention comprises a pipe-shaped adapter body member whose distal end is inserted into an opening in a beverage pack, and a fixing member that liquid-tightly fixes the distal end of the adapter body member in a state of being inserted into the opening of the beverage pack. The end of the adapter body member can also be pointed so that it will puncture the film used to seal the opening in the beverage pack.

With the above beverage pack adapter, the distal end of the pipe-shaped adapter body member is inserted into an opening in the beverage pack, so the nutritional beverage or the like contained in the beverage pack can be discharged to the outside through the adapter body member. Furthermore, since the fixing member is liquid-tightly fixes the distal end of the adapter body member in a state of being inserted into the opening in the beverage pack, even if the beverage pack is turned upside down, there will be no leakage of the nutritional beverage or the like contained in the beverage pack from the opening in the beverage pack, or more specifically, from around the adapter body member. Thus, if a catheter is connected via a tube to the adapter body member, the nutritional beverage or the like in the beverage pack can be discharged from the distal end of the catheter located underneath. If the catheter is inserted through a nostril of a patient for example, the nutritional beverage or the like can be suitably administered enterally to the prostrate patient. In other words, the nutritional beverage or the like can be suitably administered to the patient without being transferred from the beverage pack into a bag, so the work of administering the nutritional beverage or the like is easier, and contamination with harmful bacteria or the like can be prevented, allowing the nutritional beverage or the like to be ingested more hygienically.

The term "beverage pack" used herein refers to a self-standing container that holds various types of beverages, nutritional supplements, etc., and usually has a rectangular shape. These beverage packs can contain not only so-called nutritional beverages containing any of various nutrients such as vitamins and minerals, but also beverages consumed enterally and containing any of various medications, including herbal medicines, as dictated by the intended application.

In a specific aspect of the above-mentioned beverage pack adapter, the fixing member is an elastic plate-shaped member that has a through-hole of substantially the same diameter as the opening in the beverage pack and in which a pressure-sensitive adhesive layer or sticky layer is provided around the through-hole so that the plate-shaped member adheres around the opening, and the adapter body member is equipped with a seal on the base side of the distal end, the seal fitting into the through-hole in close contact therewith, and having annular ribs or male threads around the outer periphery that prevent the adapter body member from coming out of the through-hole.

With the above adapter, the through-hole in the fixing member is aligned with the opening in the beverage pack, the pressure-sensitive adhesive layer of the fixing member adheres around the opening, and the fixing member is fixed to the beverage pack. When the distal end of the adapter body member is inserted into the beverage pack through the through-hole and the opening, the seal is elastically fitted into the through-hole. Accordingly, not only is the leakage of the nutritional beverage or the like from around the adapter body member effectively prevented, but the adapter body member is also securely fixed and effectively prevented from coming out of the through-hole.

In a specific aspect of the above adapter, the adapter further comprises a flange that is provided adjacent to the seal on the opposite side from the distal end for preventing the seal from penetrating into the opening. In this case, the seal is positioned in the through-hole merely by inserting the adapter body member until the flange abuts on the fixing member, which facilitates the attachment of the beverage pack adapter.

In another specific aspect of the above adapter, the fixing member comprises (a) an adhering member, which has a through-hole of substantially the same diameter as the opening in the beverage pack, which can adhere to the beverage pack in a state in which the through-hole and the opening are aligned, and which accommodates the distal end of the adapter body member in the through-hole, and (b) a latching member which has a first latching component formed around the base side of the distal end provided to the adapter body member, and a second latching component that is formed around the through-hole provided to the adhering member and is able to latch the first latching component, and which liquid-tightly holds the adapter body member to the adhering member in a state in which the distal end is inserted into the opening through said through-hole. In this case, the latching component allows the adapter body member and the adhering member to be connected without leaking. If the first latching component consists of male threads and the second latching component consists of female threads, the adapter body member can be effectively fixed by a simple operation involving merely threading the inserted adapter body member into the through-hole.

In another specific aspect of the above adapter, the latching member comprises an annular seal that establishes close contact between a predetermined position of the through-hole of the adhering member, including the inner surface or end thereof, and the corresponding position of the distal end of an adapter body member when the first and second latching components are latched together. In this case, the annular seal allows the adapter body member and the adhering member to be detachably and liquid-tightly fixed with ease.

In another specific aspect of the above adapter, the adapter further comprises a discharge opening or discharge groove for discharging residual liquid, provided on the base side of the distal end provided to the adapter body member. In this case, the discharge opening or groove allows all of the nutritional beverage or the like contained in the beverage pack to be used, without any being wasted.

In another specific aspect of the above adapter, the adapter body member comprises a joint component on the opposite side from said distal end, for detachably connecting to a tube. In this case, a tube connected to a catheter can be easily connected to or separated from this joint component, so various kinds of beverage can be administered to a patient by switching the beverage pack and beverage pack adapter.

The beverage supply device of the present invention comprises the above-mentioned beverage pack adapter, a tubular coupling member connected at one end to the adapter body member constituting the beverage pack adapeter, and a catheter connected to the other end of the coupling member. In this case, a nutritional beverage or the like can be suitably administered to a prostrate patient without having to transfer from the beverage pack to a bag, so the work of administering nutritional beverages and so forth is easier, and the nutritional beverages and so forth can be ingested without the danger of contamination by harmful bacteria or the like.

BEST MODE FOR CARRYING OUT THE INVENTION

The beverage pack adapter and beverage supply device according to embodiments of the present invention will now be described through reference to the drawings.

First Embodiment

Figure 1:
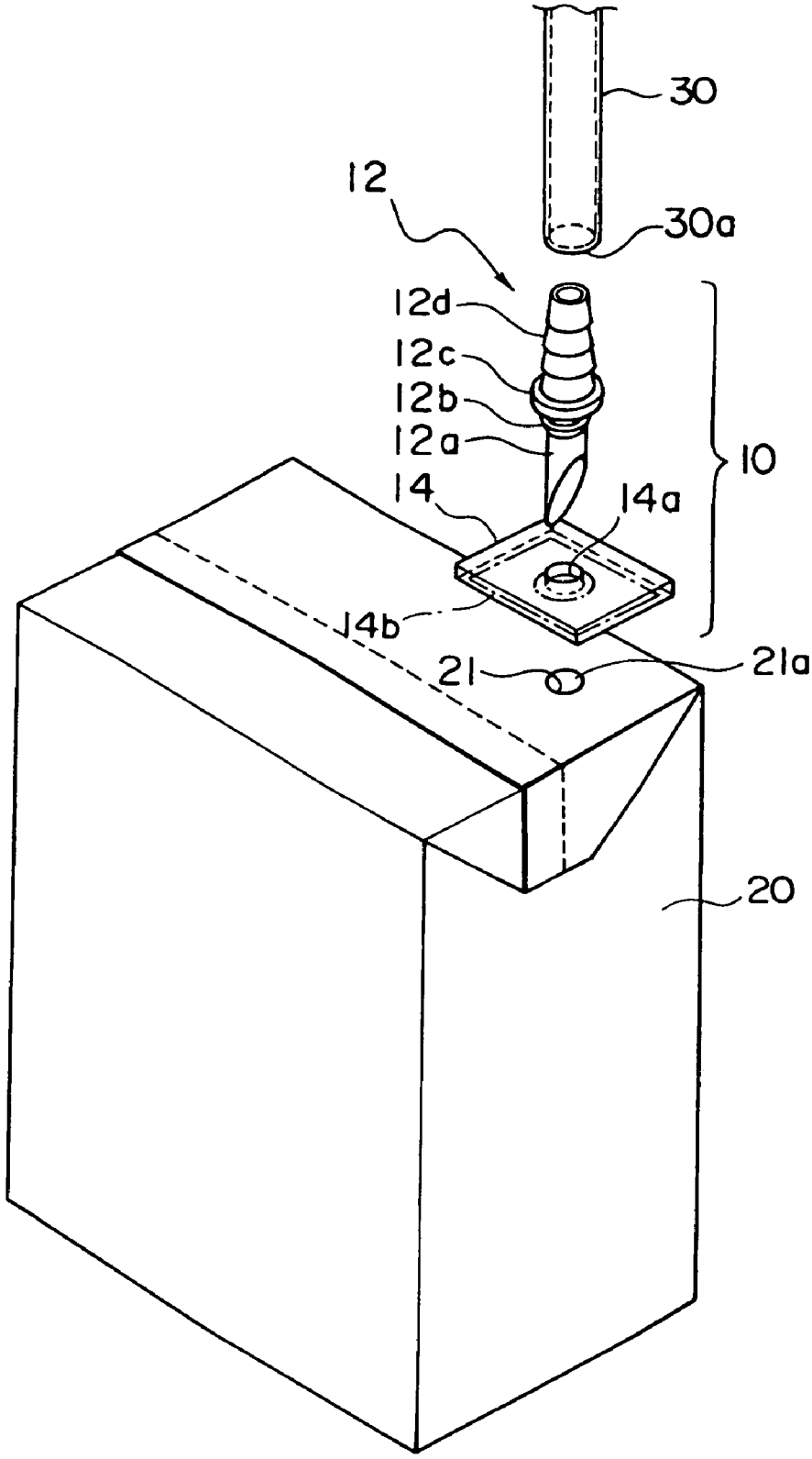
FIG. 1 is a perspective view illustrating the structure and attachment of the beverage pack adapter according to a first embodiment.

FIG. 1 is an exploded oblique view illustrating the structure of the beverage pack adapter in the first embodiment. A beverage pack adapter 10 is attached to a beverage pack 20, which is a self-standing beverage container with a rectangular shape. This beverage pack adapter 10 comprises a pipe-shaped adapter body 12 whose distal end is inserted into an opening 21 in the beverage pack 20, and a fixing member 14 that is in the form of a plate and that liquid-tightly fixes the distal end of the adapter body 12 in a state of being inserted into the opening 21 of the beverage pack 20. The upper end of the adapter body 12 is connected to a tube 30 that is linked to a catheter.

The beverage pack 20 can be purchased commercially, and is called a brick pack, tetrapack, etc. In this case, the beverage pack 20 is filled with a nutritional beverage that will provide suitable nutritional supplementation to a patient or the like. The beverage pack 20 itself is made from cardboard coated on the inside with polyethylene or another such resin material, and its surface is also coated with wax or covered with polyethylene or another such resin material. The circular opening 21 made on the upper surface serves as a straw insertion opening (straw hole), and is sealed by a film 21*a*. This film 21*a* can be punctured by a sharp edge component provided to the end of the attached drinking straw (not shown).

Of the components of the beverage pack adapter 10, the adapter body 12 comprises a pointed end 12*a* for puncturing the film 21*a* provided to the opening 21 in the beverage pack 20, a seal 12*b* that fits into and seals the through-hole 14*a* provided to the fixing member 14, a flange 12*c* that prevents the seal 12*b* from penetrating more than a certain amount into the opening 21, and a joint 12*d* that is detachably connected to the tube 30. Of these, the pointed end 12*a* and the joint 12*d* constitute the adapter body member. The adapter body 12 is formed by injection molding from a semi-hard material such as polypropylene, polyethylene, or another polyolefin, or polycarbonate, polystyrene, or the like.

Of the components of the beverage pack adapter 10, the fixing member 14 is a plate-shaped member that is flexible and elastically deformable, and has in its center the circular through-hole 14*a* of substantially the same diameter as the opening 21 in the beverage pack 20. Over substantially the entire back side of the fixing member 14, except for very close to the through-hole 14*a*, is formed a pressure-sensitive adhesive or sticky layer 14*b* for fixing the fixing member 14 to the beverage pack 20 in a state in which the through-hole 14*a* is aligned with the opening 21.

The fixing member 14 is preferably made from a material such as silicone rubber that can be elastically deformed, but a plasticized vinyl chloride resin, ethylene-vinyl acetate copolymer (EVA), polyester, polyamide, thermoplastic polyurethane, and other such flexible thermoplastic resins can also be used.

The tube 30 can be, for example, the linking member that makes up part of a commercially available infusion set. The flexible end 30*a* provides an elastic fit when the joint 12*d* is inserted with at least a certain amount of force, affording liquid-tight linking with the adapter body 12, and the other end of the tube 30 (not shown) is liquid-tightly linked to a catheter inserted into the nostril of a patient, etc. Since this end 30*a* can be separated from the joint 12*d* with a specific amount of force, the beverage pack 20 and the adapter body 12 can be replaced integrally. Specifically, the joint 12*d* can be pulled off the end 30*a*, another beverage pack 20 attached to an adapter body 12, and the new joint 12*d* thereof connected to the end 30*a* of the tube 30.

Figure 2:
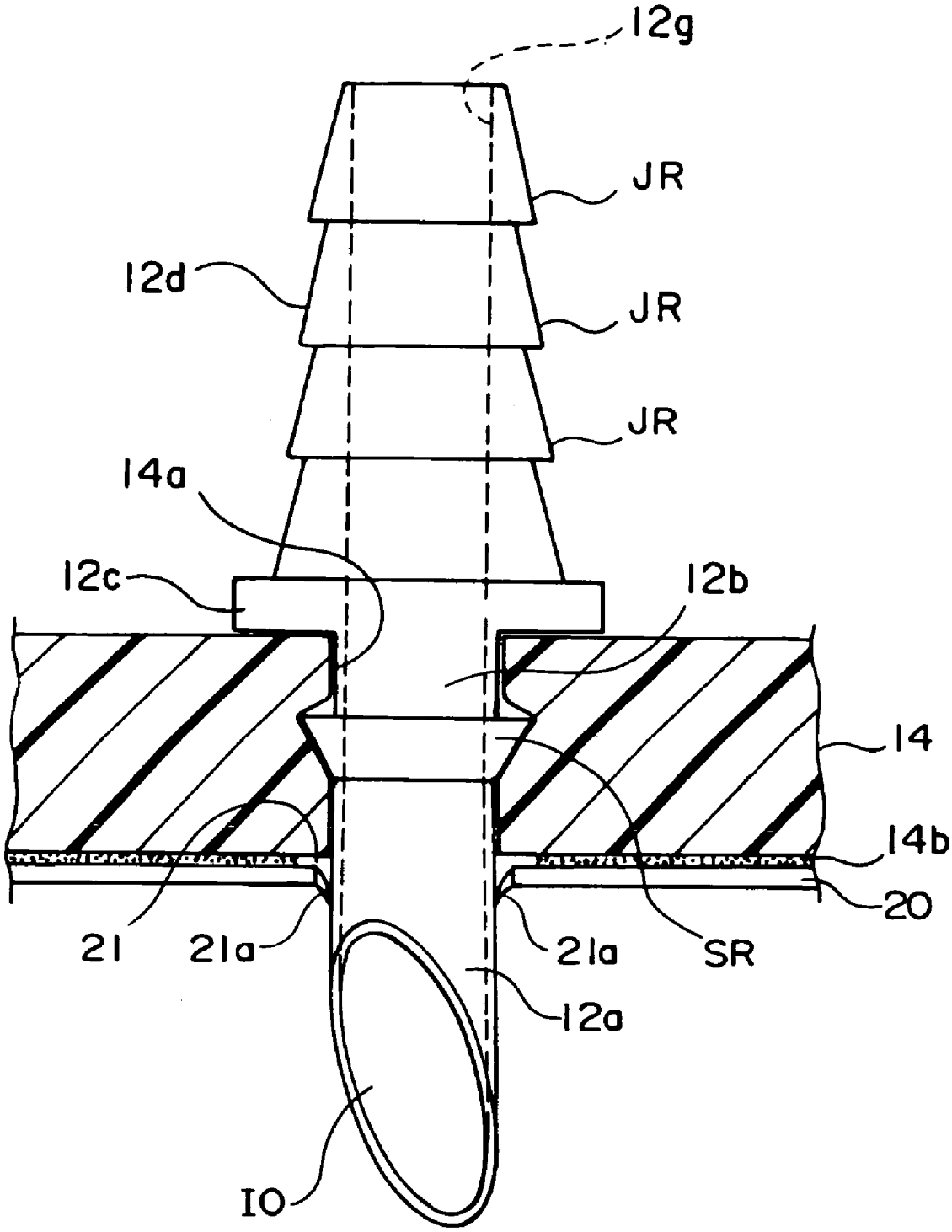
FIG. 2 is a side cross section illustrating the structure and fixing state of the beverage pack adapter in FIG. 1.

FIG. 2 is a side cross section illustrating how the beverage pack adapter 10 is fixed to the beverage pack 20.

The fixing member 14 used for liquid-tightly fixing the adapter body 12 to the beverage pack 20 is flexible and capable of elastic deformation, and is tightly fixed around the opening 21 by the adhesive layer 14*b*. The through-hole 14*a* and the opening 21 here are aligned vertically.

The shape of the pointed end 12*a* of the adapter body 12 is such as the result of cutting the pipe diagonally, and when the pointed edge is inserted into the opening 21 through the through-hole 14*a*, it punctures the film 21*a*. A slender, oval intake opening IO that extends nearly to the adjacent seal 12*b* above is formed in the pointed end 12*a*. Because of the shape and disposition of this intake opening IO, when the beverage pack 20 shown in the drawings and to which the beverage pack adapter 10 has been attached is turned upside-down, and the nutritional beverage inside is discharged through the adapter body 12 to a catheter (not shown), substantially all of the nutritional beverage in the beverage pack 20 can be discharged without any being left over, which cuts down on waste.

The diameter of the seal 12*b* is slightly larger than the original diameter of the through-hole 14*a* which is capable of elastic deformation, and is tightly fitted into the through-hole 14*a* of the fixing member 14, which prevents the nutritional beverage in the beverage pack 20 from leaking around the seal 12*b*. An annular ridge SR is formed around the outer periphery in the vertically middle part of the seal 12*b*. This ridge SR has a triangular cross section with a sharp apex, and this sharp apex indents the inner wall of the through-hole 14*a*, which prevents the adapter body 12 from falling out of the beverage pack 20 when the unit is turned upside-down. Only one ridge SR is provided in the depicted example, but a plurality of such ridges SR can be provided as dictated by the thickness of the fixing member 14 and other such considerations.

The flange 12*c* has a diameter approximately twice the diameter of the through-hole 14*a*. This prevents the seal 12*b* from being pushed all the way into the opening 21 when the pointed end 12*a* is inserted into the opening 21. Specifically, the seal 12*b* is accurately positioned in the depth direction of the through-hole 14*a* merely by pushing in the adapter body 12 until the flange 12*c* abuts on the fixing member 14.

The joint 12*d* is slightly tapered, and a plurality of annular ridges JR are formed around the outer periphery thereof. These ridges JR give a serrated appearance in a vertical cross section of the joint 12*d*, and when the joint 12*d* is connected to the tube 30 in FIG. 1, they come into close contact with the inner face of the end 30*a* of the elastically deformed tube 30, which prevents liquid leakage at this portion and also prevents the tube 30 from falling out of the adapter body 12 fixed to the beverage pack 20 when the unit is turned upside-down.

The intake opening IO provided to the pointed end 12*a* communicates with a passage 12*g* that goes through the seal 12*b*, the flange 12*c*, and the joint 12*d*, and the nutritional beverage in the beverage pack 20 is drawn out through this passage 12*g*.

The job of attaching the beverage pack adapter 10 will now be described. First, a sterilized fixing member 14 is readied, and the protective seal on the back is removed to expose the adhesive layer 14*b*. Next, the through-hole 14*a* and the opening 21 are aligned, and the fixing member 14 is fixed to the beverage pack 20 in this state. A sterilized adapter body 12 is then readied, and the pointed end 12*a* thereof is inserted into the opening 21 through the through-hole 14*a*. As a result, the pointed end 12*a* punctures the film 21*a* and goes into the opening 21, but the flange 12*c* serves as a stopper so that only the pointed end 12*a* enters the beverage pack 20. The seal 12*b* keeps the surrounding area liquid-tight, and the ridge SR provided to the seal ensures this liquid-tight fit and also prevents the adapter body 12 from falling out.

Figure 3:
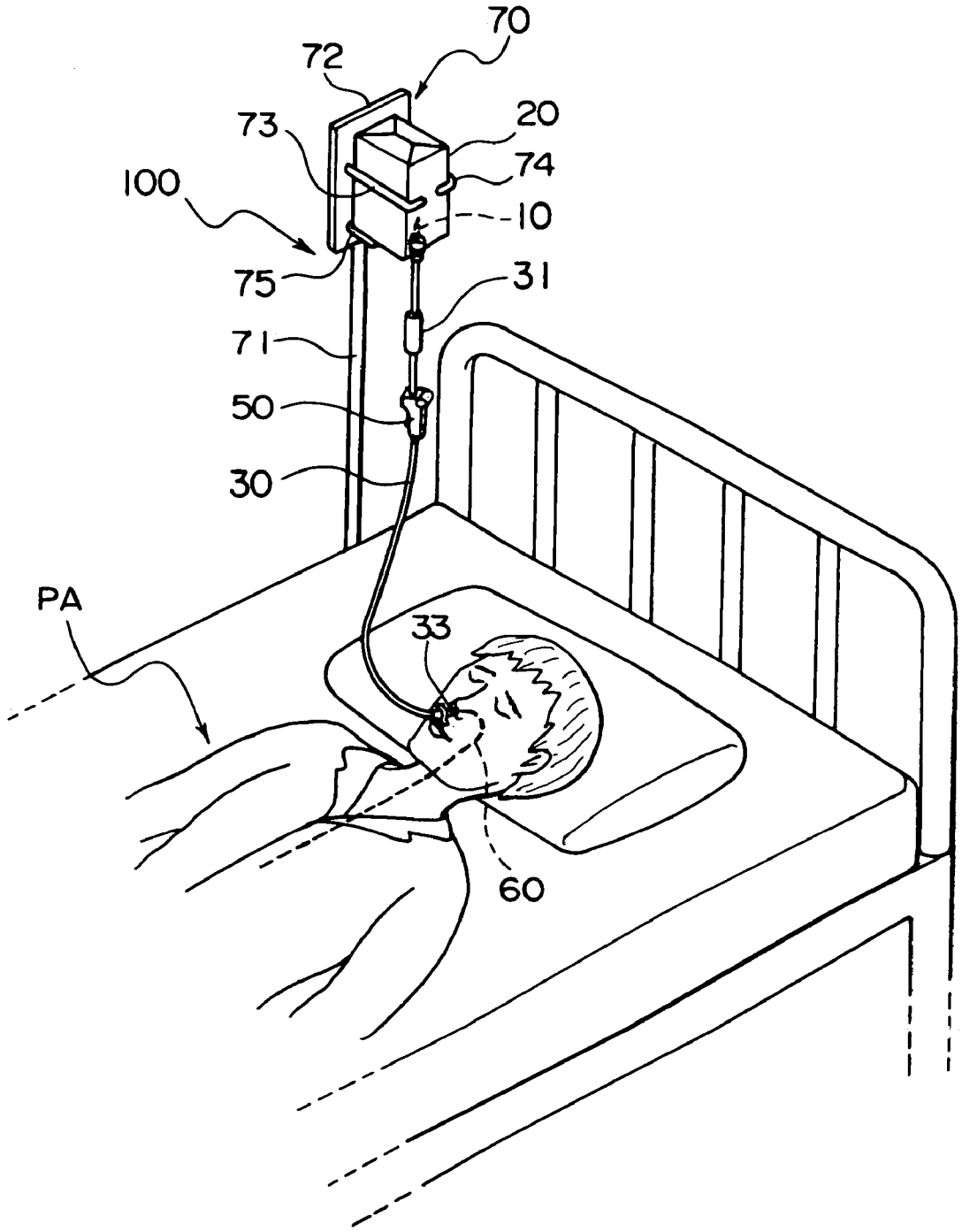
FIG. 3 is a simplified diagram illustrating the structure and use of a beverage supply device that makes use of the beverage pack adapter in FIG. 1.

FIG. 3 is a diagram illustrating a beverage supply device 100 that makes use of the beverage pack adapter 10 shown in FIGS. 1 and 2. Just as with an ordinary infusion set, a drip tube 31 is provided at some place along the tube 30 extending from the beverage pack adapter 10 fixed to the beverage pack 20. A clamp 50 for adjusting the feed rate of the nutritional beverage is provided under the drip tube 31. A joint 33 is formed at the distal end of the tube 30, and a catheter 60, which is a slender or thin tube, is connected via this joint 33. The catheter 60 is inserted through the nostril of a patient PT, and extends to the stomach or intestine.

The beverage pack 20 is fixed to a special stand 70. This stand 70 comprises a back plate 72 attached to the top of a support pole 71, a pair of arms 73 and 74 extending from the middle of the back plate 72, and a support member 75 extending from the lower part of the back plate 72. The beverage pack 20 is held laterally by the arms 73 and 74 and is supported from underneath by the support member 75. The stand 70 does not have to be constructed as above, and may instead be of a type with which the beverage pack 20 is hung upside-down, for instance.

The assembly and attachment of the beverage supply device 100 will now be described. First, the adapter body 12 is fixed to the beverage pack 20 (see FIG. 2), one end of the tube 30 is connected to the joint 12*d* of the adapter body 12, and the catheter 60 is connected to the other end of the tube 30, which completes the assembly of the beverage supply device 100. The assembled beverage supply device 100 is then attached to the stand 70. Specifically, the beverage pack 20 is turned upside-down and moved above the arms 73 and 74, the tube 30 is passed through the gap between the arms 73 and 74, and then the beverage pack 20 is lowered, which allows the beverage pack 20 to be held at the desired height by the arms 73 and 74 and the support member 75. In this state, the clamp 50 is adjusted, any air in the tube 30 is purged, and the catheter 60 is inserted through the nostril of the patient PT. The clamp 50 is again adjusted to adjust the amount of nutritional beverage discharged from the catheter 60. At this point air can be released from the beverage pack 20 by puncturing a suitable location at the bottom of the beverage pack 20 or cutting off a suitable portion, which will allow the nutritional beverage to be discharged more smoothly from the catheter 60. Once the beverage pack 20 is empty, it is removed from the stand 70 and the tube 30 is taken out. If one beverage pack 20 does not provide sufficient beverage, a new beverage pack 20 is readied and fixed to the adapter body 12 in the same way as above. One end of the tube 30 is then reconnected to the joint 12*d* of the new adapter body 12 (see FIG. 2). Thereafter, the amount of nutritional beverage discharged from the catheter 60 is adjusted with the clamp 50 in the same manner as above.

Second Embodiment

The beverage pack adapter in a second embodiment will now be described. The beverage pack adapter in this embodiment is a variation on the beverage pack adapter in the first embodiment, the same components are numbered the same, and common portions will not be described again.

Figure 4:
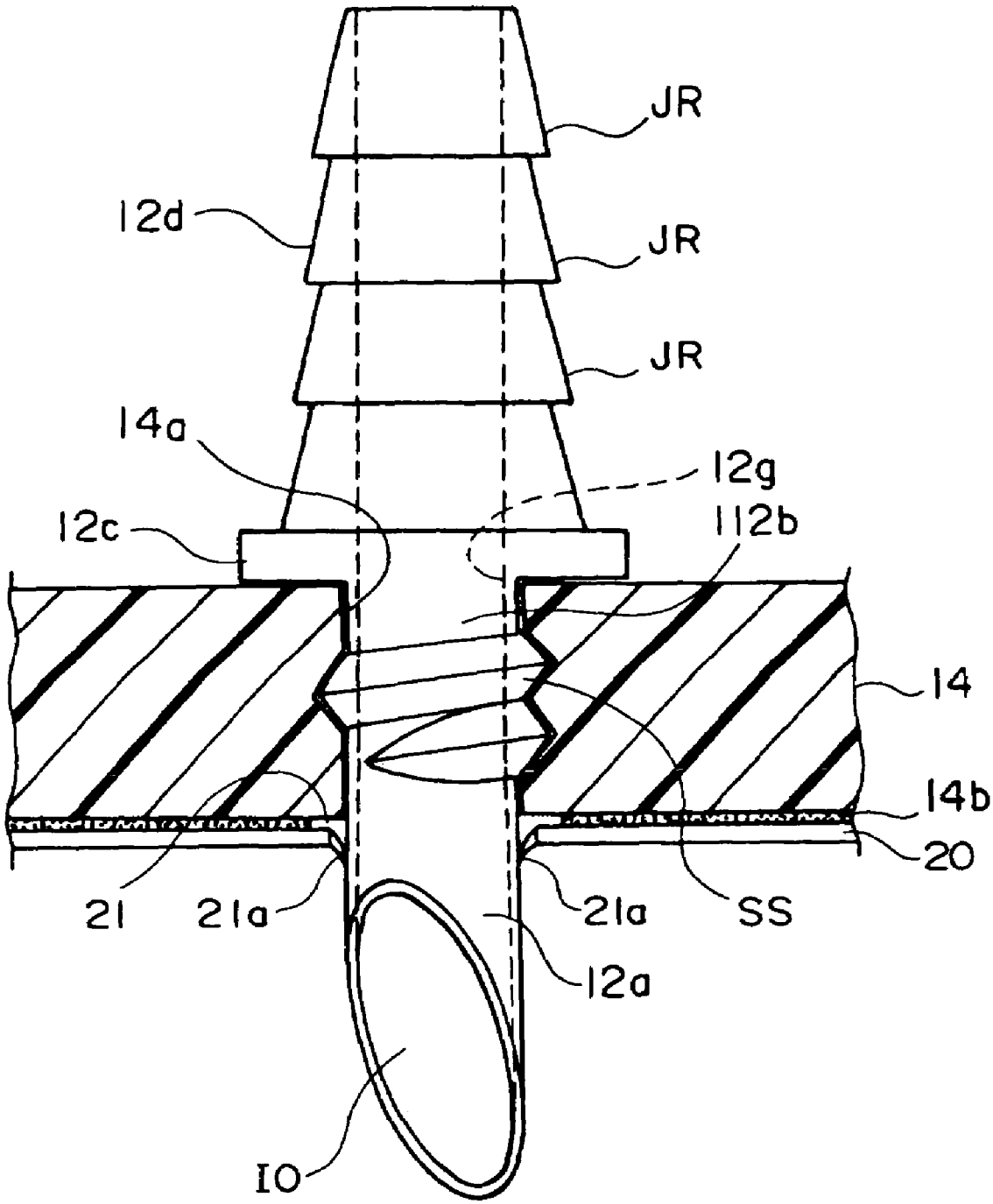
FIG. 4 is a side cross section of the beverage pack adapter according to a second embodiment.

FIG. 4 is side cross section illustrating the structure of the beverage pack adapter in a second embodiment. Here, male threads SS are formed instead of the ridge SR (see FIG. 2) around the outer periphery of a seal 112*b*. This seal 112*b* is turned and threaded into the through-hole 14*a*, which causes the male threads SS to bite into the inner wall of the through-hole 14*a*, so that the seal 112*b* is tightly fitted in the through-hole 14*a*. As a result, the nutritional beverage in the beverage pack 20 can be prevented from leaking from around the seal 112*b*, and the adapter body 12 can also be prevented from falling out of the beverage pack 20 when the unit is turned upside-down. The pitch and number of the male threads SS can be suitably varied as dictated by the thickness and elasticity characteristics of the fixing member 14.

Third Embodiment

Figure 5:
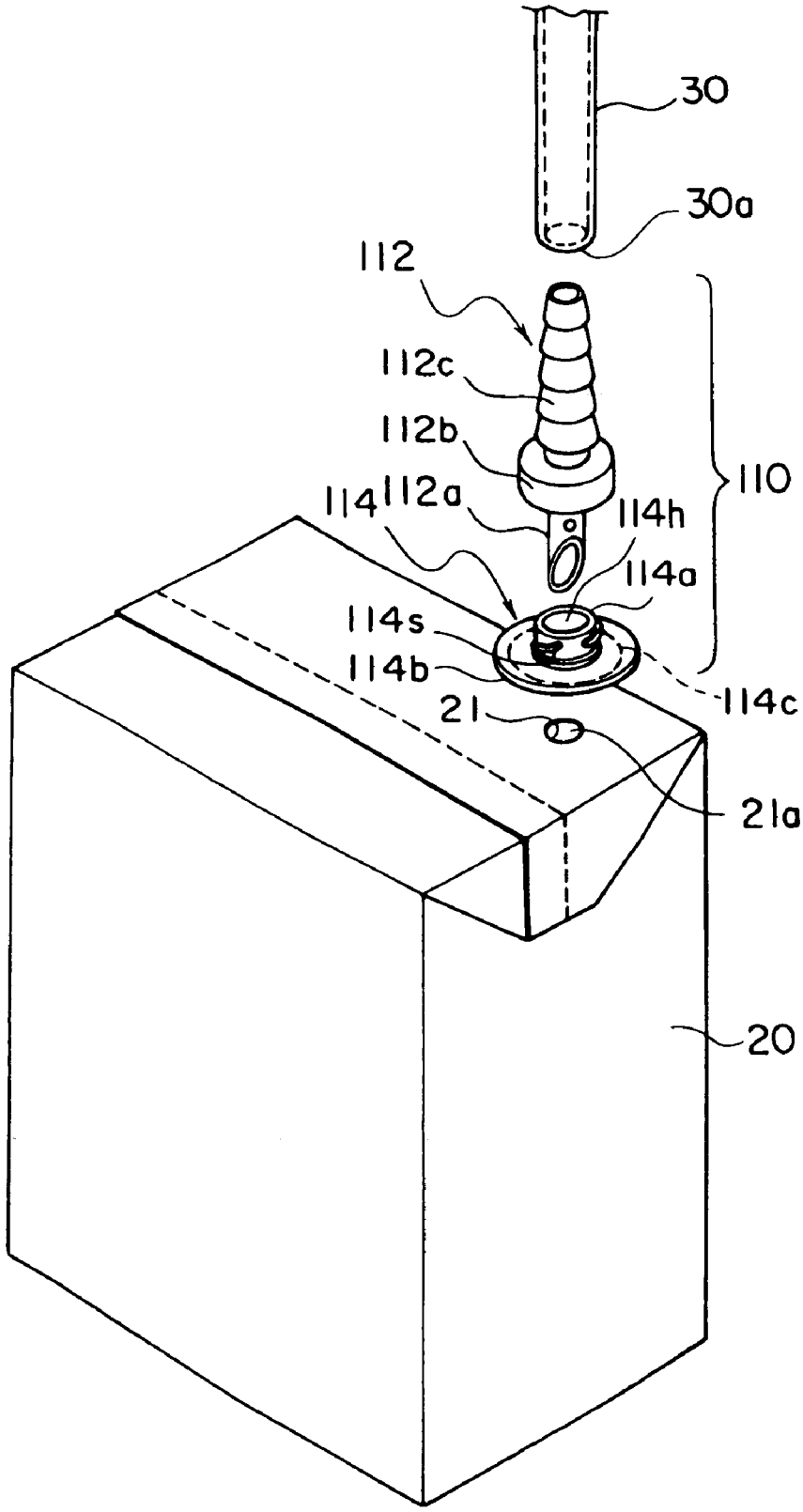
FIG. 5 is a perspective view illustrating the structure and attachment of the beverage pack adapter according to a third embodiment.

FIG. 5 is an exploded oblique view illustrating the structure of the beverage pack adapter in a third embodiment. This beverage pack adapter 110 comprises a pipe-shaped adapter body 112 whose distal end is inserted into the opening 21 in the beverage pack 20, and a linking member 114 that is bonded to the beverage pack 20 and accommodates the distal end of the adapter body 112. The upper end of the adapter body 112 can be connected to the tube 30 that is connected to a catheter at the other end.

Of the components of the beverage pack adapter 110, the adapter body 112 comprises a pointed end 112*a* for puncturing the film 21*a*provided to the opening 21 in the beverage pack 20, an annular member 112*b* that is provided around the base of this pointed end 112*a* and is fastened to a cylindrical component 114*a* of the linking member 114, and a joint 112*c* that is provided on the opposite side from the pointed end 112*a* and is detachably connected to the tube 30. Fastening female threads (not shown) that engage with male threads 114*s* formed around the sides of the cylindrical component 114*a* are formed on the insides of the outer peripheral wall of the annular member 112*b*. The adapter body 112 is formed by injection molding from a semi-hard material such as polypropylene, polyethylene, or another polyolefin, or polycarbonate, polystyrene, or the like.

Of the components of the beverage pack adapter 110, the linking member 114 has the cylindrical component 114*a* having a circular through-hole 114*h* of the same inside diameter as the opening 21 in the beverage pack 20, and a bonding flange 114*b* that extends in the circumferential direction from the lower end of the cylindrical component 114*a*. Here, the inside diameter of the through-hole 114*h* of the cylindrical component 114*a* is slightly larger than the outside diameter of the pointed end 112*a*, allowing the pointed end 112*a* to be inserted into the through-hole 114*h*. Male threads 114*s*consisting of three thread ridges are formed on the sides of the cylindrical component 114*a*, that is, around the through-hole 114*h*. Each of the thread ridges that make up these male threads 114*s* has a length corresponding to approximately one pitch when converted into length in the axial direction, and the ridges of the threads are formed separately in three areas on the sides of the cylindrical component 114*a*. The pitch and number of the male threads 114*s* can be suitably varied as dictated by the size of the linking member 114 and so forth. An adhesive layer 114*c* is formed over substantially the entire backside of the flange 114*b*, except for the area near the through-hole 114*h*. This adhesive layer 114*c* allows the linking member 114 to be fixed to the beverage pack 20 in a state in which the through-hole 114*h* and the opening 21 are aligned. The linking member 114 is also formed by injection molding from a semi-hard material such as polypropylene, polyethylene, or another polyolefin, or polycarbonate, polystyrene, or the like.

In the above description, of the components of the adapter body 112, the pointed end 112*a* and the joint 112*c* constitute the adapter body member. The linking member 114, that is, the cylindrical component 114*a* and the flange 114*b*, constitutes the adhering member. The annular member 112*b* of the adapter body 112 and the cylindrical component 114*a* of the linking member 114 constitute a latching member for locking.

Figure 6:
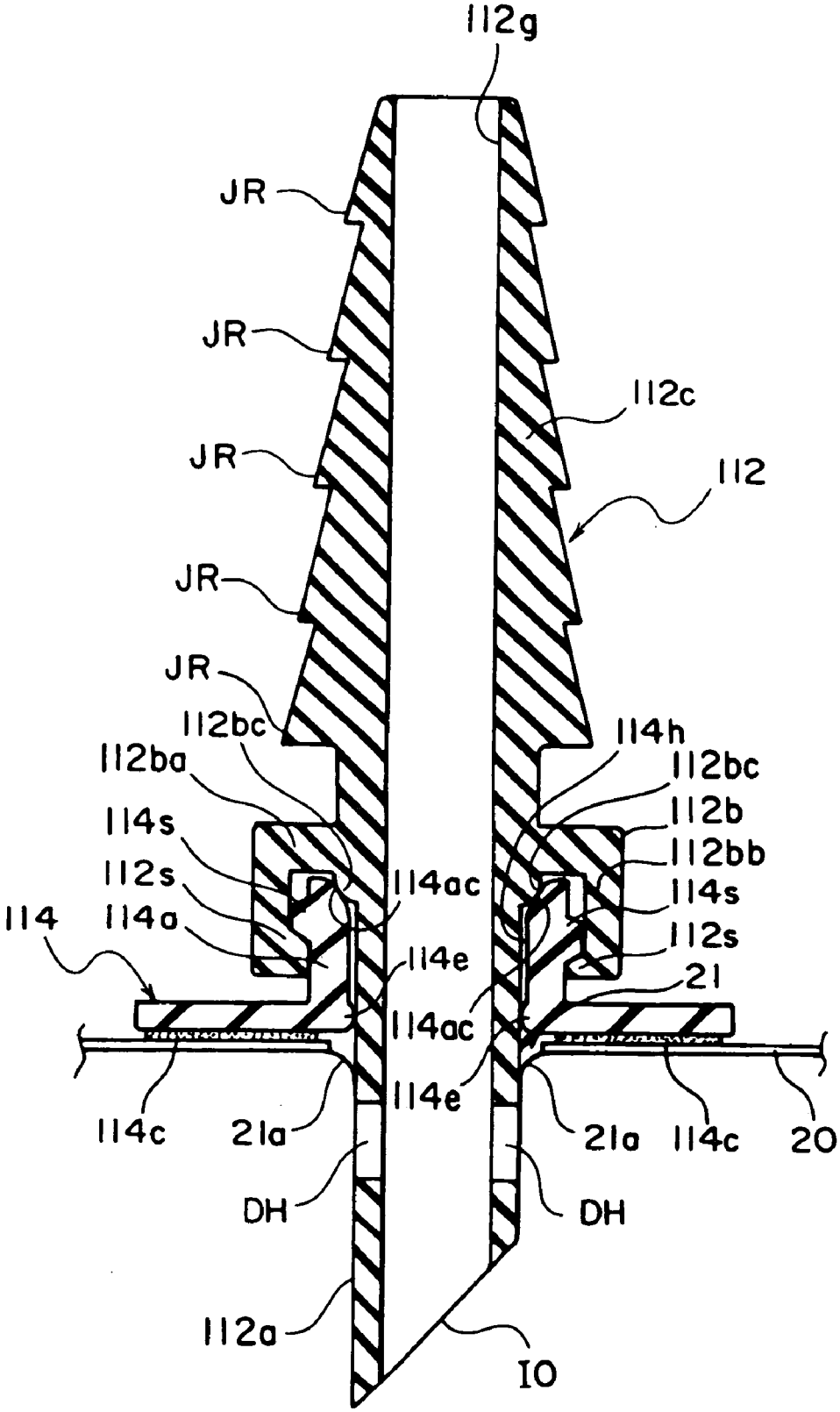
FIG. 6 is a side cross section illustrating the structure and fixing state of the beverage pack adapter in FIG. 5.

FIG. 6 is a side cross section illustrating how the beverage pack adapter 110 is fixed to the beverage pack 20.

The linking member 114 used for liquid-tightly fixing the adapter body 112 to the beverage pack 20 is fixed around the opening 21 in close contact therewith by the adhesive layer 114*c*. The through-hole 114*h* and the opening 21 here are aligned vertically.

Figure 7:
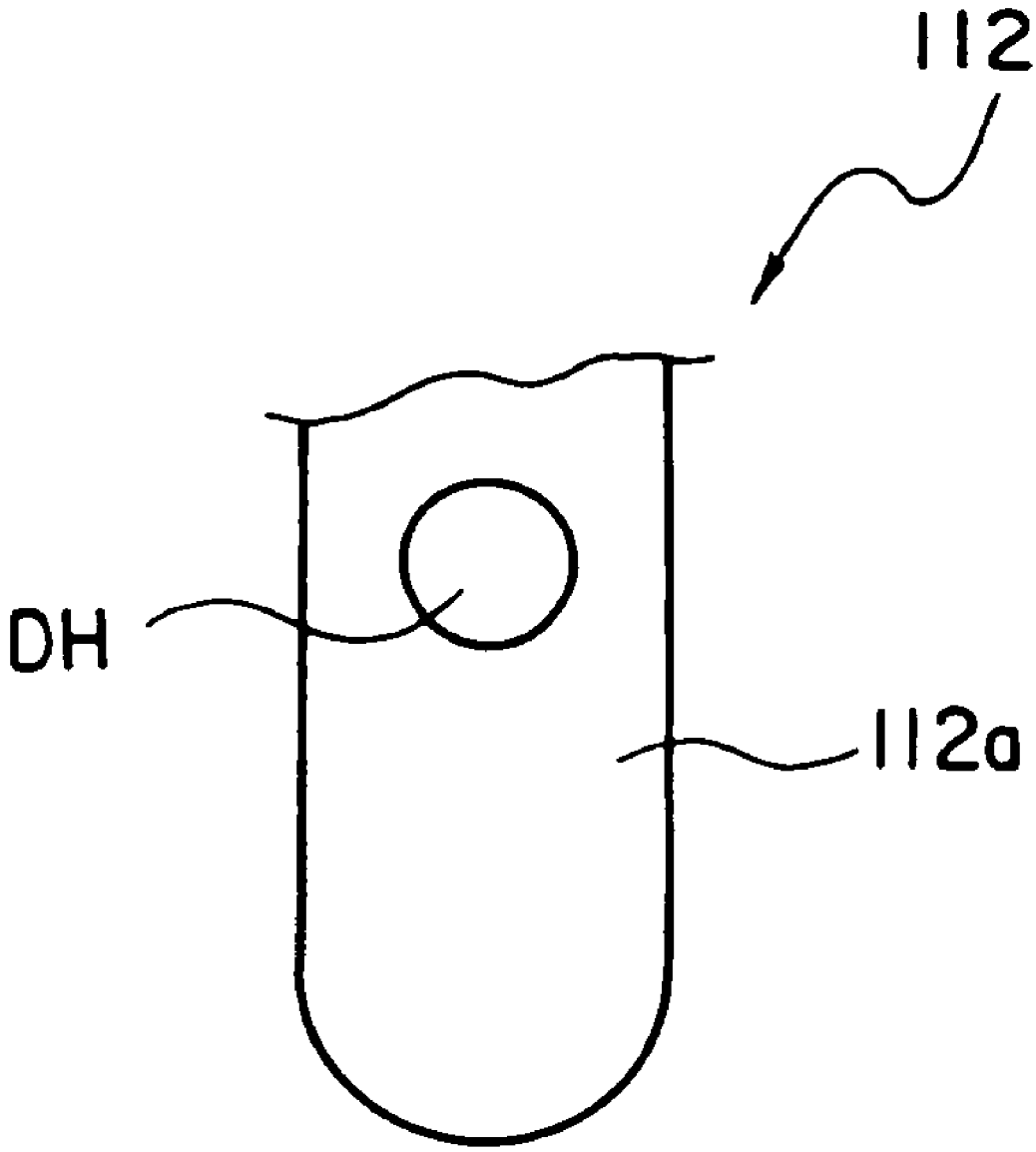
FIG. 7 is a side view of the pointed end of the beverage pack adapter in FIG. 6.

The shape of the pointed end 112*a* of the adapter body 112 is such as the result of cutting the pipe diagonally, and when the pointed edge is inserted into the opening 21 through the through-hole 114*h*, it punctures the film 21*a*. The oval intake opening IO is formed at the pointed end 112*a*. A discharge hole DH for discharging any remaining liquid is formed at the base side of the pointed end 112*a*, or more specifically, in between the intake opening IO and the annular member 112*b*. FIG. 7 is a side view of the distal end of the pointed end 112*a*, and shows the shape and disposition of the discharge hole DH. This discharge hole DH allows substantially all of the nutritional beverage in the beverage pack 20 to be discharged to the catheter, preventing the beverage from being left over and thereby cutting down on waste.

Referring back to FIG. 6, the annular member 112*b* consists of a flange 112*ba* that extends radially outward from the base of the pointed end 112*a*, and a collar 112*bb* that extends downward from the outer edge of this flange 112*ba*. The cylindrical component 114*a* of the linking member 114 is fitted into the space between the pointed end 112*a* and the annular member 112*b*, that is, inside the collar 112*bb*. Here, the male threads 114*s*, which are a first latching component formed around the outer periphery of the cylindrical component 114*a*, engage with female threads 112*s*, which are a second latching component formed on the inside of the collar 112*bb*, thereby fixing the adapter body 112 to the linking member 114.

An annular rib 112*bc* is formed underneath the flange 112*ba* where it attaches. This rib 112*bc* tightly fits into an annular recess 114*ac* formed on the inside of the distal end of the cylindrical component 114*a*. The rib 112*bc* and the recess 114*ac* constitute a seal, which prevents the nutritional beverage from leaking out from the cylindrical component 114*a*. An annular rib 114*e* is also formed at the inside base of the cylindrical component 114*a*. This rib 114*e* serves as a seal by contacting closely with the outer periphery of the annular member 112*b*, which prevents the nutritional beverage from leaking out from the cylindrical component 114*a*.

The joint 112*c* is slightly tapered, and a plurality of annular ridges JR are formed around the outer periphery thereof. These ridges JR prevent liquid leakage at the connection portion when the joint 112*c* is connected to the tube 30 in FIG. 5, and also prevent the tube 30 from falling out of the adapter body 112. Furthermore, the intake opening IO and the discharge hole DH provided to the pointed end 112*a* communicate with a passage 112*g* that goes through the joint 112*c*, which allows the nutritional beverage in the beverage pack 20 is drawn out through this passage 112*g*.

The job of attaching the beverage pack adapter 110 will now be described. First, a sterilized linking member 114 is readied, and the protective seal on the back is removed to expose the adhesive layer 114*c*. Next, the linking member 114 is fixed to the beverage pack 20 in a state in which the through-hole 114*h* and the opening 21 are aligned. A sterilized adapter body 112 is then readied and fixed to the linking member 114. More specifically, the pointed end 112*a* is inserted into the opening 21 through the through-hole 114*h* provided to the cylindrical component 114*a*, and the annular member 112*b* is turned clockwise with a suitable force. This causes the annular member 112*b* to mesh with the cylindrical component 114*a*, locking the adapter body 112 to the linking member 114, and the pointed end 112*a* punctures the film 21*a* and is inserted into the opening 21. The surrounding are is kept liquid-tight by the rib 112*bc*, recess 114*ac*, and rib 114*e*, which are a seal. Liquid-tightness is also ensured and the adapter body 112 is prevented from falling out by the cylindrical component 114*a* and the annular member 112*b*, which are a latching member.

The beverage pack adapter 110 shown in FIGS. 1 and 2 is incorporated into a beverage supply device that is the same as the beverage supply device 100 shown in FIG. 3. Specifically, a drip tube, clamp, joint, catheter, and so forth are connected to the extension of the tube 30. The beverage pack 20 is fixed to a stand that is the same as the stand 70.

Fourth Embodiment

The beverage pack adapter in a fourth embodiment will now be described. The beverage pack adapter in this embodiment is a variation on the beverage pack adapter according to the third embodiment.

Figure 8:
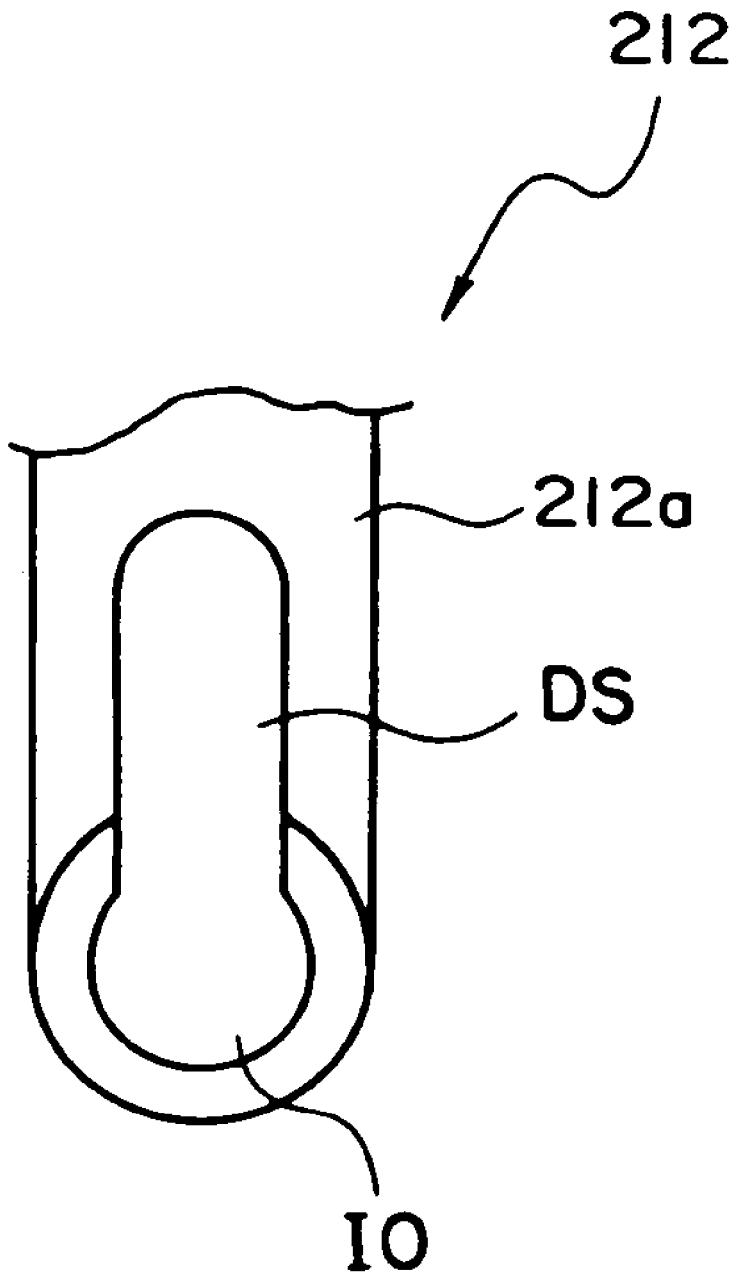
FIG. 8 is a side view of the beverage pack adapter according pertaining to a fourth embodiment.

FIG. 8 is a side view of part of a modified adapter body 212. In this case, a discharge groove DS is provided to a pointed end 212*a* of an adapter body 212. This discharge groove DS also allows substantially all of the nutritional beverage in the beverage pack 20 to be discharged to the catheter, preventing the beverage from being left over and thereby cutting down on waste.

The present invention was described above through embodiments, but is not limited to these embodiments. For instance, in the above embodiments the pointed end 12*a* or 112*a* of the adapter body 12 or 112 punctured the film 21*a* provided to the opening 21 of the beverage pack 20, but if the opening 21 of the beverage pack 20 is sealed with a pull tab, after this pull tab is removed to uncover the opening 21, the fixing member 14 or the linking member 114 is fixed around the opening 21. After this, in the first and second embodiments, the pointed end 12*a* of the adapter body 12 is just inserted into the through-hole 14*h* and the opening 21. In the third and fourth embodiments, the pointed end 112*a* of the adapter body 112 is just inserted in the through-hole 114*h* and the opening 21, and the annular member 112*b* is screwed, thereby fixing the adapter body 112 to the linking member 114.

Also, a case in which a nutritional beverage was administered nasally by the beverage supply device 100 was described in the above embodiments, as shown in FIG. 4, but the patient PT can also be given long-term tubal feeding by either a route through gastric fistula or a route through enteral fistula. Specifically, a gastric or enteric fistula is formed at a suitable location in the abdomen of the patient PT, and the catheter 60 is attached to the gastric or enteric fistula. The nutritional beverage or the like in the beverage pack 20 can be supplied in a suitable quantity and at a suitable timing to the stomach or intestines of the patient PT through the beverage pack adapter 10 or 110, the tube 30, and the catheter 60.

Also, the through-hole 14*a* and the opening 21 had the same diameter in the first and second embodiments above, but the through-hole 14*a* can instead be made somewhat smaller than the opening 21. In this case, a certain amount of misalignment is allowed between the through-hole 14*a* and the opening 21. Conversely, the through-hole 14*a* can be made somewhat larger than the opening 21, but in this case the diameter of the pointed end 12*a* must be smaller than the diameter of the seal 12*b* or 112*b*, and either the same as or smaller yet than the diameter of the opening 21.

Further, the nasal or enteral consumption of a beverage using a beverage pack in the narrow sense was described in the above embodiments, but the present invention is not limited to such nasal or enteral ingestion, and can be applied more broadly to transvenous feeding in which an infusion or the like is introduced at another site such as a vein. In this case, nutrients can be given tubally to a patient or the like by attaching an adapter as described in the above embodiments to a more broadly defined beverage pack, including a nutritional pack containing nutritional substances or the like.

The invention claimed is:

1. A beverage pack adapter, comprising:

a pipe-shaped adapter body member whose distal end is to be inserted into a straw insertion opening in a beverage pack; and a fixing member that is able to fix liquid-tightly the distal end of the adapter body member in a state in which said distal end is inserted into the opening of the beverage pack, wherein the fixing member comprises:

a through-hole of substantially the same diameter as the straw insertion opening in the beverage pack; and an exposed adhesive layer configured to adhere the fixing member to the beverage pack in a state in which said through-hole and said opening are aligned, and which can accommodate the distal end of the adapter body member in the through-hole.

2. The beverage pack adapter according to claim 1, wherein the fixing member comprises:

a latching member which can liquid-tightly hold the adapter body member to the fixing member in a state in which said distal end is inserted into said opening through said through-hole.

3. The beverage pack adapter according to claim 2 wherein said latching member comprises a first latching component formed around the base side of said distal end, and a second latching component that is formed around the through-hole of the fixing member and is able to latch the first latching component.

4. The beverage pack adapter according to claim 3, wherein the first latching component is an annular member including a collar member having a female thread inside thereof, and the second latching component is a cylindrical component having a male thread outside thereof.

5. The beverage pack adapter according to claim 2 wherein the latching member comprises an annular seal that establishes close contact between a predetermined position of the through-hole of the fixing member and the corresponding position of the distal end of the adapter body member when the latching member holds the adapter body member to the fixing member.

6. The beverage pack adapter according to claim 4, wherein the latching member comprises an annular seal that establishes close contact between a predetermined position of the through-hole inside the cylindrical component and the corresponding position of the base side of said distal end when the first and second latching components are latched together.

7. The beverage pack adapter according to claim 6, wherein the annular seal comprises an annular rib formed around the base side of the distal end of the adapter body member and an annular recess formed inside a distal end of the cylindrical component, and the annular rib fits tightly into the annular recess when the collar member is screwed and engaged to the cylindrical component.

8. A beverage pack adapter comprising:

a pipe-shaped adapter body member whose distal end is to be inserted into a straw insertion opening in a beverage pack; and a fixing member that is able to fix liquid-tightly the distal end of the adapter body member in a state in which said distal end is inserted into the opening of the beverage pack;

wherein the fixing member is an elastic plate-shaped rubber member that has a through-hole of substantially the same diameter as the opening in the beverage pack and in which an adhesive layer which is exposed for attaching the beverage pack adapter to the beverage pack is provided around the through-hole so that the plate-shaped member adheres around the opening, and the adapter body member is equipped with a seal on the base side of said distal end, the seal fitting into the through-hole in close contact therewith, and having annular ribs or male threads around the outer periphery that prevent the adapter body member from coming out of the through-hole.

9. The beverage pack adapter according to claim 8, further comprising a flange that is provided adjacent to the seal on the opposite side from the distal end for preventing said seal from penetrating into the opening.

10. The beverage pack adapter according to claim 1, further comprising a discharge opening or discharge groove for discharging residual liquid, provided on the base side of the distal end of said adapter body member.

11. The beverage pack adapter according to claim 1, wherein the adapter body member further comprises a joint component on the opposite side from said distal end, for detachably connecting to a tube.

12. The beverage pack adapter according to claim 1, wherein the distal end of said adapter body member has a pointed end that has a shape of a pipe cut diagonally at one end thereof.

13. A beverage pack adapter, comprising:

a pipe-shaped adapter body member whose distal end is to be inserted into a straw insertion opening in a beverage pack;

a fixing member that is able to fix liquid-tightly the distal end of the adapter body member in a state in which said distal end is inserted into the opening of the beverage pack, wherein the fixing member comprises:

a through-hole of substantially the same diameter as the straw insertion opening in the beverage pack; and an exposed adhesive layer configured to adhere the fixing member to the beverage pack in a state in which said through-hole and said opening are aligned, and which can accommodate the distal end of the adapter body member in the through-hole;

a tubular coupling member connected at one end to the adapter body member of the beverage pack adapter; and a catheter connected to the other end of the coupling member.

14. A beverage supply device according to claim 13, wherein said coupling member is equipped with a clamp and a drip tube.

15. The beverage pack adapter according to claim 13, wherein the fixing member comprises:

a latching member which can liquid-tightly hold the adapter body member to the fixing member in a state in which said distal end is inserted into said opening through said through-hole.

16. The beverage pack adapter according to claim 15, wherein said latching member comprises a first latching component formed around the base side of said distal end, and a second latching component that is formed around the through-hole of the fixing member and is able to latch the first latching component.

17. The beverage pack adapter according to claim 16, wherein the first latching component is an annular member including a collar member having a female thread inside thereof, and the second latching component is a cylindrical component having a male thread outside thereof.

18. The beverage pack adapter according to claim 15, wherein the latching member comprises an annular seal that establishes close contact between a predetermined position of the through-hole of the fixing member and the corresponding position of the distal end of the adapter body member when the latching member holds the adapter body member to the fixing member.

19. The beverage pack adapter according to claim 17, wherein the latching member comprises an annular seal that establishes close contact between a predetermined position of the through-hole inside the cylindrical component and the corresponding position of the base side of said distal end when the first and second latching components are latched together.

20. The beverage pack adapter according to claim 19, wherein the annular seal comprises an annular rib formed around the base side of the distal end of the adapter body member and an annular recess formed inside a distal end of the cylindrical component, and the annular rib fits tightly into the annular recess when the collar member is screwed and engaged to the cylindrical component.

* * * * *